United States Patent [19]

Funahashi

[11] 4,064,802

[45] Dec. 27, 1977

[54] ROTARY STAMP

[76] Inventor: Takaji Funahashi, No. 2-1, Kitatakasho, Nishi, Nagoya, Aichi, Japan

[21] Appl. No.: 735,527

[22] Filed: Oct. 26, 1976

[30] Foreign Application Priority Data

Nov. 6, 1975 Japan ..... 50-151185[U]
May 25, 1976 Japan ..... 51-6696[U]

[51] Int. Cl.[2] ..... B41K 1/10

[52] U.S. Cl. ..... 101/327; 101/105; 101/110; 101/316; 101/371

[58] Field of Search ..... 101/327, 371, 373, 105, 101/110, 316, 287, 288, 368

[56] References Cited

U.S. PATENT DOCUMENTS

| | | | |
|---|---|---|---|
| 1,029,568 | 6/1912 | Folger et al. | 101/105 |
| 1,401,436 | 12/1921 | Pannier | 101/105 |
| 2,179,269 | 11/1939 | Ogden | 101/110 |
| 2,839,994 | 6/1958 | Haag | 101/372 |
| 2,853,002 | 9/1958 | Robinson | 101/327 |
| 3,432,018 | 3/1969 | Watanabe et al. | 107/36 |

*Primary Examiner*—Edgar S. Burr
*Assistant Examiner*—William Pieprz

[57] ABSTRACT

A rotary stamp comprises an upper frame including printing members formed on endless belts and a lower frame including another printing member and when the upper frame is pressed down, the printing members of the endless belts are located on a plane common with the other printing member of the lower frame and printing is accomplished simultaneously by these printing members, vertical slots are formed on the side plates of the upper frame and spring means having projections capable of being engaged with these slots and sliding along these vertical slots are disposed in the lower frame.

2 Claims, 14 Drawing Figures

ROTARY STAMP

BACKGROUND OF THE INVENTION

This invention relates to a rotary stamp. More particularly, the invention relates to a rotary stamp having rotary printing members and another printing member that can print at the same time as the rotary printing members.

A conventional rotary stamp of this type comprises a substantially reverse U-shaped upper frame including a top plate and a pair of facing side plates connected to both ends of the top plate, respectively, a fixed shaft supported substantially midway between said side plates, a bridge laid out between the lower end of said side plates, a plurality of cylindrical rotary members rotatably supported on said fixed shaft in said upper frame, each rotary member having an annular disc formed integrally with one end thereof and toothed on the circumference, a plurality of endless belts, each endless belt being stretched around said bridge and the corresponding rotary member and having on the surface thereof a plurality of printing members, and a lower frame including a plate having an opening at the center thereof and another printing member bonded to the lower face of said plate, wherein the printing members of the endless belts can be positioned in said opening of the lower frame on a plane common with said other printing member on the lower face of the plate of the lower frame when the endless belts are located below said bridge.

According to this conventional rotary stamp, two groups of letters or dates can be stamped on one sheet of paper simultaneously by the printing members of the endless belts and the other printing member on the lower face of the plate of the lower frame. It is preferred that the two groups of letters or dates stamped by both of the printing members and the other printing member be as close to each other as possible. However, if both the printing members are disposed so that the groups of stamped letters or dates are close to each other, it is impossible to move the endless belts smoothly since the printing member of the belts strikes either the plate around the opening or the other printing member.

As means for overcoming this defect, there have been proposed several structures, for example, (1) a structure in which the opening of the lower frame is enlarged, (2) a structure in which the lower frame is disposed dismountably from the upper frame, and (3) a structure in which the lower frame is pivoted on the upper frame so that the lower frame can be turned according to need.

When the structure (1) is adopted, the letters or dates printed by the printing members of the endless belts and the other printing member of the lower frame are spaced from each other and the printed letters or dates cannot easily be read correctively. When the structure 2 is adopted, the operation of dismounting the lower frame and attaching it to the upper frame is troublesome and the efficiency is reduced. When the structure 3 is adopted, the disadvantages encountered in case of the structures 1 and 2 can be avoided. However, this structure fails to meet a user3 s desire that one of a number of lower frames provided be freely chosen and combined with the upper frame.

SUMMARY OF THE INVENTION

It is a primary object of the present invention to provide a rotary stamp of the above-mentioned type in which endless belts can be smoothly rotated and letters or dates printed in an easily readible fashion.

Another object of the present invention is to provide a rotary stamp of the above-mentioned type in which the upper frame can be vertically moved precisely with respect to the lower frame, and printing members of the endless belts and another printing member of the lower frame can be precisely located on a common plane.

Still another object of the present invention is to provide a rotary stamp in which the lower frame can easily be separated from the upper frame and exchanged with another lower frame, whereby the stamp can be conveniently used for various purposes.

In accordance with the present invention, there is provided a rotary stamp comprising an upper frame having a substantially U-shaped form as a whole and including a top plate and a pair of facing side plates connected to both ends of the top plate, respectively, each side plate having at least one vertical slot in the lower portion thereof, a fixed shaft supported substantially midway between said side plates, a bridge laid out between the lower ends of said side plates, a plurality of cylindrical rotary members rotatably supported on said fixed shaft in said upper frame, each rotary member having an annular disc formed integrally with one end thereof and toothed on the circumference, a plurality of endless belts, each endless belt being stretched around said bridge and the corresponding rotary member and having on the surface thereof a plurality of printing members, a lower frame including a plate having an opening at the center thereof and a pair of facing frame plates attached in an erect posture on both sides of said opening, respectively, said plate having another printing member fixed to the lower face thereof by bonding or other means and said opening having such a size that when the endless belts are located below said bridge, the printing members of said endless belts are well fitted in with said opening, and spring means attached to the inside of each frame plate, each spring means having on the inner face thereof at least one projection to be engaged with said vertical slot and capable of sliding along said vertical slot, wherein by engagement of the projections on the spring means with the vertical slots on both the side plates and sliding movement of said projections along said vertical slots, said upper frame is allowed to move in the vertical direction with respect to the lower frame and when the endless belts are located below said bridge, the printing members of the endless belts are allowed to move in the vertical direction along a distance between a position at which said printing members of the endless belts are on a plane common with said other printing member on the lower face of the plate of the lower frame and a position retreated from said position.

In accordance with another feature of the present invention, there is provided a rotary stamp of the abovementioned structure wherein each of said side plates of the upper frame has a pair of parallel vertical slots, each frame plate of said lower frame has a pair of inwardly facing side plates connected to both the side ends thereof, each of said spring means includes a central plate, a pair of spring plates connected to both the side ends of the central plate and a reverse T-shaped arm plate connected to the lower end of said central plate, each of said spring plates has on the inner face thereof a projection to be engaged with a corresponding one of said vertical slots and capable of sliding along said vertical slot, the central plate of each spring means is attached to the inner face of said frame plate, each spring plate is arranged so that a spacing is formed betwee the spring plate and the inner face of said frame plate and also between the outer end of the spring plate and said inwardly facing side plate, and wherein said reverse T-shaped arm plate has a pair of arm members in the lower portion thereof, and the lower end of each arm member is pressed to the plate of the lower frame and the free end of each arm member is kept in contact with said inwardly facing side plate.

In accordance with still another feature of the present invention, there is provided a rotary stamp of the above-mentioned structure wherein each of printing members of said endless belts and said other printing member fixed to the lower face of the plate of the lower frame is composed of a porous material capable of absorbing ink therein.

DETAILED DESCRIPTION OF THE PREFERRED EMBODIMENTS:

The present invention will now be described with reference to embodiments illustrated in the accompanying drawings, in which.

Figure 1:
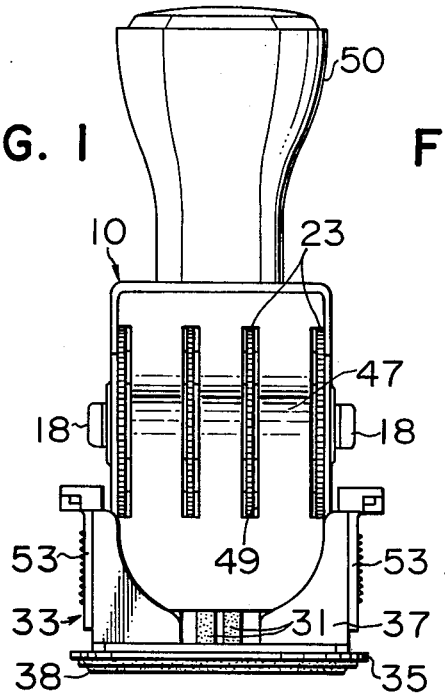
FIG. 1 is a front view illustrating one embodiment of the rotary stamp of the present invention.
Figure 2:
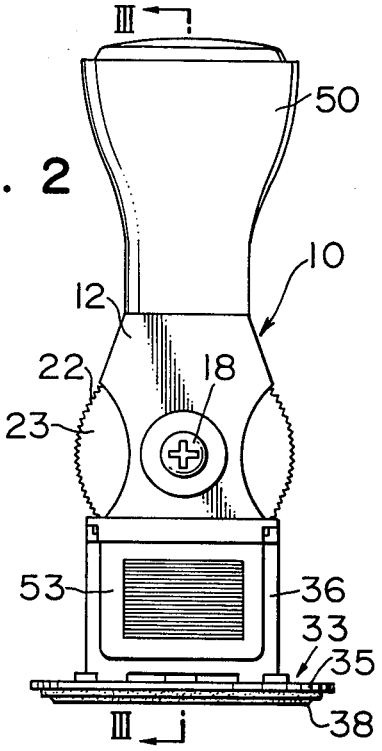
FIG. 2 is a side view of the rotary stamp shown in FIG. 1.

Referring to the drawings, an upper frame 10 has a substantially reverse U-shaped form as a whole, and it includes a top plate 11 and a pair of side plates 12 connected to both ends of the top plate 11, respectively.

Each side plate 12 has at least one vertical slot 13 in the lower portion thereof, preferably a pair of parallel vertical slots 13. The vertical slot 13 consists of an upper circular hole portion 14, a lower circular hole portion 15 having the same diameter as that of the upper hole portion 14 and a groove 16 connected between these hole portions 14 and 15 and having a width smaller than the diameter of the circular hole portions 14 and 15.

Each side plate 12 has a vertical elongated hole 17 in the intermediate portion thereof, and a set screw 18 is inserted into the elongated holes 17 of both the side plates and is screwed in screw holes 20 on both the ends of a shaft 19 disposed between both the side plates 12, whereby the shaft 19 is fixed to the side plates 12.

A plurality of cylindrical rotary members 21 are rotatably supported on the shaft 19. Each rotary member 21 has an annular disc 23 formed intergrally with one end thereof and this disc 23 has teeth 22 on the circumference.

A bridge 24 is laid out between the lower ends of both the side plates 12. This bridge 24 includes a long plate 25, portions 26 extending from both the ends of the long plate 26, respectively, in the horizontal direction, portions 27 extending upwardly from the ends of said extending portions 26, respectively, and side portions 28 extending upwardly from both the side ends of the long plate 25, respectively. A step 29 is formed between each horizontally extending portion 26 and the long plate 25, so that the horizontal extending portion 26 is located slightly above the long plate 25. Each side portion 28 has projections 30 on both the ends of the outer face thereof.

The bridge 24 is mounted on the side plates 12 by engaging the upwardly extending portions 27 with the lower ends of the side plates of the upper frame 10.

Each of a plurality of endless belts 31 is stretched around the bridge 24 and the corresponding rotary member 21 and supported between the projections 30 so that the belt 31 is prevented from slipping toward the step 29. Each endless belt 31 has on the surface thereof a plurality of printing members 32 composed of a porous material capable of absorbing ink therein.

A lower frame 33 includes a circular plate 35 having a rectangular openin 34 at the center thereof and a pair of frame plates 36 attached in an erect posture on the plate 35 on both the sides of the opening 34.

Each frame plate 36 has a pair of inwardly facing side plates 37 connected to both the side ends thereof. The spacing between both the side plates 37 is substantially equal to the width of the lower portion of each side plate 12 of the upper frame 10.

The plate 35 has a printing member 38 fixed to the lower face thereof by bonding or other means, and the printing member 38 is composed of a porous material capable of absorbing ink therein.

The opening 34 has such a size that when the endless belt is located below the bridge 24, the printing member 32 of the endless belt is fitted in with the opening 34.

Spring means comprises a rectangular central plate 39, a pair of rectangular spring plates 40 connected to both the side ends of the central plate 39, respectively, and a reverse T-shaped arm 41 connected to the lower end of the central plate 39. Each spring plate 40 has a projection 42 to be engaged with the vertical slot 13 and capable of sliding along the vertical slot 13.

The central plate 39 of each spring means is fixed to the inner face of the frame plate 36 by welding or nuts. Each spring plate 40 is arranged so that there is formed a spacing *a* between the outer face of the spring plate 40 and the inner face of the frame plate 36 and there is also formed a spacing *b* between the outer end of the spring plate 40 and the inwardly facing side plate 37.

The reverse T-shaped arm plate 41 has in the lower portion thereof a pair of arm members 43, and the arm plate 41 is arranged so that there is formed a spacing *c* between the upper end of each arm member 43 and the lower end of each spring plate 40 and the free end of each arm member 43 is kept in contact with the inwardly facing side plate 37.

The top plate 11 of the upper frame 10 has an opening 44 at the center thereof. A cover platestopping plate 45 has substantially the same size as that of the top plate 11, and the plate 45 has an opening 46 at the center thereof. A cover plate 47 has a size substantially equal to the spacing between the side plates 12 of the upper frame 10 and the cover plate 47 has a pair of bent portions 48 on the top end thereof and a plurality of vertical slits 49 in which the annular disc 23 can be inserted. A notch 60 is formed on the lower end of the cover plate 47.

A handle 50 has a screw hole 51 on the lower end. A screw 52 is inserted through the opening 46 of the cover plate-stopping plate 45 and the opening 44 of top plate 11 of the upper frame 10 and screwed into the screw hole 51 of the handle 50, and bent portions 48 of the cover plate 47 are gripped between the cover plate-stopping plate 45 and the top plate 11 and the notch 60 on the lower end of the cover plate 47 is engaged with the side portion 28 of the bridge 24, whereby the cover plate 47 and the upper frame 10 are fixed to the handle 50.

A cover 53 of the lower frame 33 is attached to the outer faces of the frame plates 36, and this cover 53 is composed of a plastic material.

In the rotary stamp having the above structure, when the side plates 12 of the upper frame 10 are pressed into the spacing between the frame plates 36 of the lower frame 33, the side plates 12 are supported by the side plates 37 of the frame plates 36 having a size substantially equal to the width of the lower portions of the side plates 12 and elastically held by the spring plates 40. In this state, each projection 42 is engaged with the corresponding slot 13.

Figure 3:
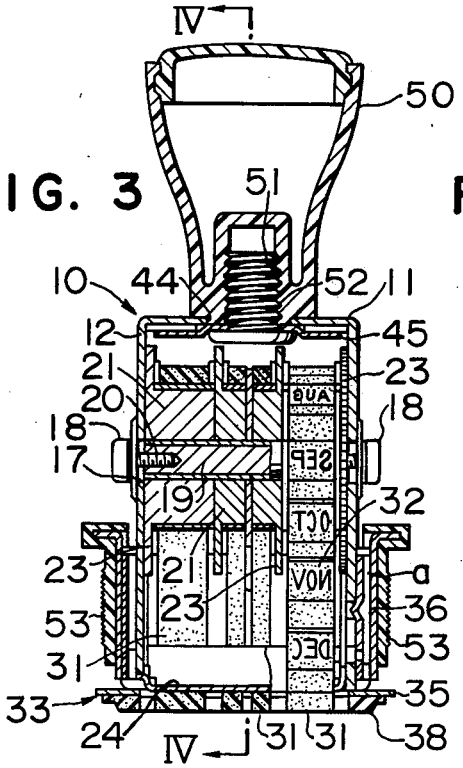
FIG. 3 is a view showing the section taken along the line III—III in FIG. 2.
Figure 4:
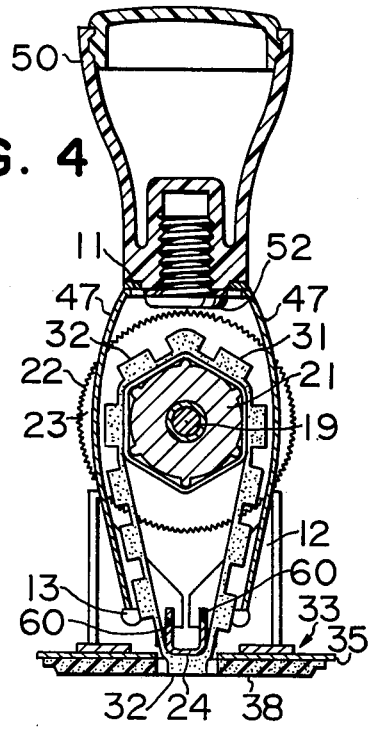
FIG. 4 is a view showing the section taken along the line IV—IV in FIG. 3.
Figure 5:
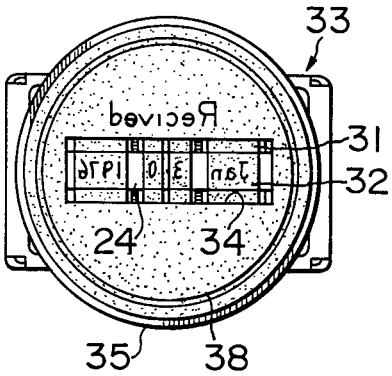
FIG. 5 is a bottom view of the rotary stamp.
Figure 6:
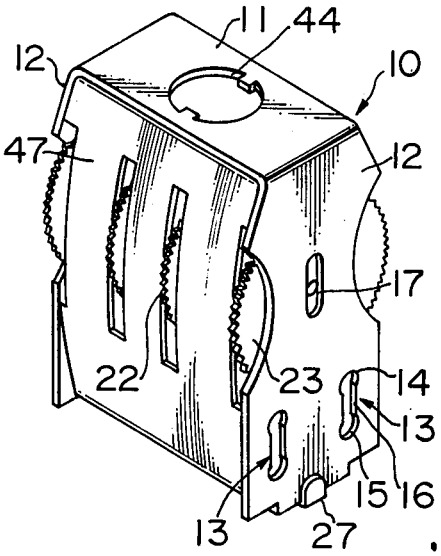
FIG. 6 is a perspective view showing the upper frame.
Figure 7:
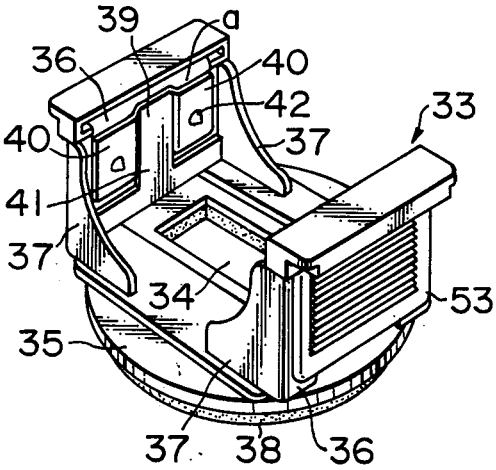
FIG. 7 is a perspective view showing the lower frame.
Figure 8:
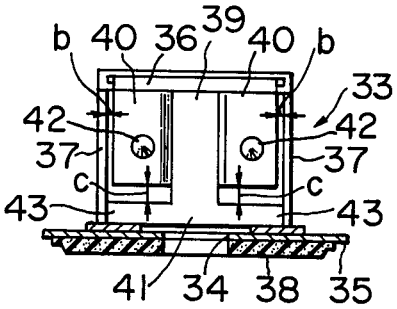
FIG. 8 is a view showing the longitudinal section of the lower frame.
Figure 9:
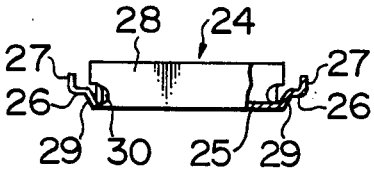
FIG. 9 is a front view of the bridge.
Figure 10:
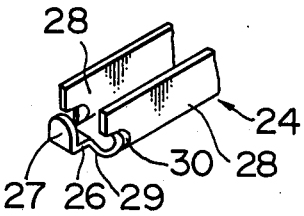
FIG. 10 is a partially cut-out perspective view of the bridge.
Figure 11:
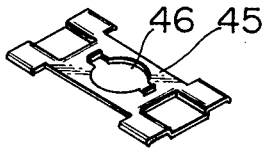
FIG. 11 is a perspective view of a cover platestopping plate.
Figure 12:
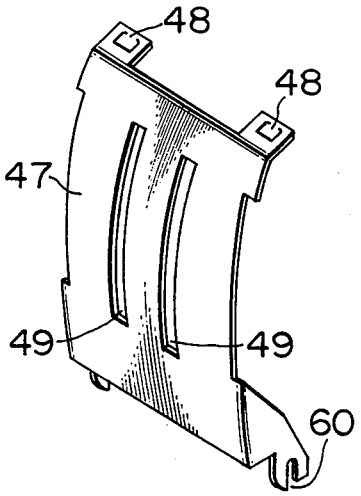
FIG. 12 is a perspective view of a cover plate.
Figure 13:
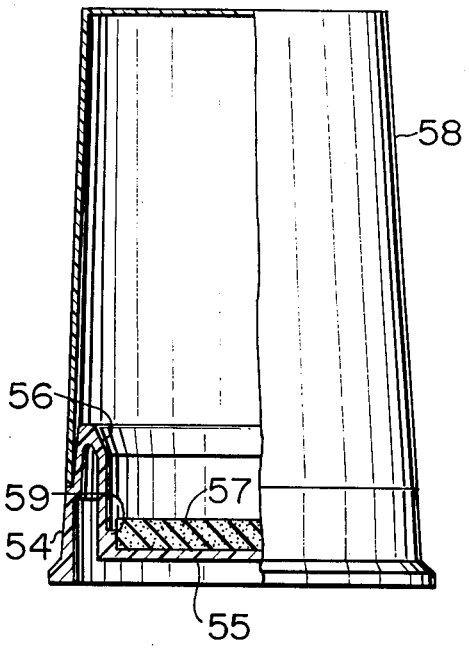
FIG. 13 is a partially longitudinally sectional view of an ink pad and a cover therefor.
Figure 14:
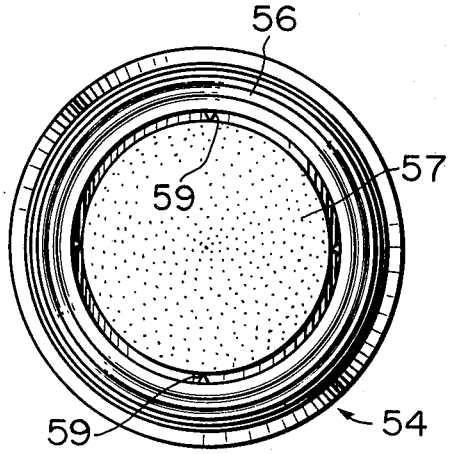
FIG. 14 is a plane view of the ink pad.

When the upper frame 10 is pressed into the lower frame 33 so that each projection 42 arrives at the upper circular hole portion 14 of the vertical slot 13, as shown in FIGS. 3 and 4, the printing members 32 of the endless belts 31 located below the long plate 25 of the bridge 24 are fitted in with the opening 34 of the lower frame 33, and the printing members 32 are made to come close to the printing member 38 on the lower face of the plate 35 of the lower frame 33 and are positioned on a plane common with the printing member 38. Accordingly, paper can be simultaneously stamped by both the printing members 32 and the printing member 38.

It is preferred that the printing members 32 on the endless belts 31 be projected outwardly over the printing member 38 on the lower face of the plate 35 of the lower frame 33 by about 0.3 mm. It has been experimentally confirmed that good results are obtained by this arrangement.

When it is extended to exchange the printing members 32 on the endless belts 31 for another printing member 31, the upper frame 10 is lifted up and separated from the lower frame 33. At this point, each projection 42 engaged with the upper circular hole portion 14 of the vertical slot 13 departs from the hole portion 14, passes through the groove 16 and arrives at the lower circular hole portion 15. Simultaneously, the printing members 32 on the endless belts 31 escape from the hole 34 of the lower frame 33 and are shifted above the opening 34, though this state is not specifically shown in the drawings.

When the endless belts 31 are turned in the above state, the endless belt 31 can be smoothly turned and a desired printing members 32 are ready for printing since the printing members 32 do not strike the plate 35 of the lower frame 33 or the printing member 38.

When the turning of the endless belts 31 are completed, the upper frame 10 is pressed into the lower frame 33 and the above-mentioned original state is once again attained.

The upper frame 10 is elastically held by the spring plates 40 and supported in the lower frame 33 by engagement between the projections 42 and the vertical slots 13. Accordingly, the upper frame 10 can be moved very simply and precisely in the vertical direction with respect to the lower frame 33. Further, the upper frame 10 is gripped by a pair of side plates 37 of the lower plate 33 which face each other with a spacing substantially equal to the width of the lower portions of the side plates 12 of the upper frame 10, and the position of the upper frame 10 is fixed tightly by said side plates 37 and shaking of the upper frame 10 is prevented.

If desired, the lower frame 33 may be exchanged with another frame to which a different printing member is attached. In this case, as in the case where the printing members 32 of the endless belts 31 are exchanged, the upper frame 10 is lifted up and separated from the lower frame 33. Then, projections 42 were shifted to the lower circular hole portions 15 of the vertical slots 13, and the uppei frame 10 is further pulled up more intensely. At this point, the projections 42 escape from the lower circular portions 15 and the lower frame 33 is completely separated from the upper frame 10. Then, another lower frame is set.

As is apparent from the foregoing illustration, while the rotary stamp is used, the spring plate 40 of the spring means co-operates with the vertical slot 13 to hold tightly the connection between the upper frame and the lower frame. Further, the spring plate 40 and the vertical slot 13 function to temporarily separate the upper frame from the lower frame by a prescribed distance or to separate the upper frame completely from the lower frame according to need.

Moreover, since the lower end of each arm member 43 of the arm plate 41 of such spring means is pressed into the plate 35 and the arm member has such a length that both the ends thereof are kept in contact with the side plates 37 of the frame plate 36, this arm plate 41 facilitates the operation of determining the position of the spring means when the spring means is fixed to the frame plate 36 and the arm plate 41 is very effective for holding the spring means stably after it has been fixed to the frame plate 36.

Since the step 29 is formed between the long plate 35 and each horizontally extending portion 26 of the bridge 24, it is quite easy to locate the printing members 32 of the endless belts 31 on a plane common with the printing member 38 of the lower frame 33.

An ink pad 54 comprises a bottom plate 55, a wall 56 disposed around the bottom plate 55, a porous plate member 57 disposed on the bottom plate 55 and a cover 58 to be fitted in with the surrounding wall 56. This porous plate member 57 can absorb ink therein, and it is stopped by a click member 59 disposed on the inside of the surrounding wall 56. When the rotary stamp is not used, if the stamp is stored in the state placed on the porous plate member 57 of the ink pad 54, ink is supplied to the printing members 32 and 38 from the ink pad, and the rotary stamp is stored in such state that it can be used at any time.

What is claimed is:

1. A rotary stamp comprising an upper frame having a substantially U-shaped form and including a top plate and a pair of facing side plates connected to both ends of the top plate, respectively, a fixed shaft supported substantially midway between said side plates, a bridge laid out between the lower ends of said side plates, a plurality of cylindrical rotary members rotatably supported on said fixed shaft in said upper frame, each rotary member having an annular disc formed integrally with one end thereof and toothed on the circumference thereof, a plurality of endless belts, each endless belt being stretched around said bridge and the corresponding rotary member and having on the surface thereof a plurality of printing members, a lower frame including a plate having an opening at the center thereof and a pair of facing frame plates attached in an erect posture on both sides of said opening, respectively, said plate having another printing member fixed to the lower face thereof by bonding or other means and said opening having such a size that when the endless belts are located below said bridge, the printing members of said endless belts are well fitted within said opening, the improvement comprising the provision in each of said side plates of the upper frame, of a pair of parallel vertical slots, each frame plate of said lower frame having a pair of inwardly facing side plates connected to both the side ends thereof, spring means attached to the inside of each frame plate of said lower frame, each of said spring means including a central plate and a pair of spring plates connected to both side ends of the central plate, each of said spring plates having, on the inner face thereof a projection to be engaged with a corresponding one of said vertical slots and capable of sliding along said vertical slots, the central plate of each spring means being attached to the inner face of said frame plate, each spring plate being arranged so that a spacing is formed between the spring plate and the inner face of said frame plate and a spacing is also formed between the outer end of the spring plate and said inwardly facing side plates, a T-shaped arm plate connected to the lower end of said central plate, said T-shaped arm plate having a pair of arm members in the lower portion thereof, and the lower end of each arm being pressed into the plate of the lower frame and the free end of each arm being kept in contact with said inwardly facing side plate wherein by engagement of the projections on the spring means with the vertical slots on both the side plates and sliding movement of said projections along said vertical slots, said upper frame is allowed to move in the vertical direction with respect to the lower frame and when the endless belts are located below said bridge, the printing members of the endless belts are allowed to move in the vertical direction along a distance between a position at which said printing members of the endless belts are on a plane common with said other printing member on the lower face of the plate of the lower frame and a position retreated from said position.

2. A rotary stamp as set forth in claim 1 wherein each of printing members of said endless belts and said other printing member fixed to the lower face of the plate of the lower frame is composed of a porous material capable of absorbing ink therein.

* * * * *

UNITED STATES PATENT OFFICE

CERTIFICATE OF CORRECTION

Patent No. 4,064,802 Dated December 27, 1977

Inventor(s) TAKAJI FUNAHASHI

It is certified that error appears in the above-identified patent and that said Letters Patent are hereby corrected as shown below:

FOREIGN APPLICATION PRIORITY DATA

Japanese Application 51-6696 [u]

should be corrected to read --

51-66696 [u] --.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*